US009329547B2

(12) United States Patent
Yamakawa et al.

(10) Patent No.: US 9,329,547 B2
(45) Date of Patent: May 3, 2016

(54) FIXING DEVICE AND IMAGE FORMING APPARATUS

(71) Applicant: KYOCERA Document Solutions Inc., Osaka (JP)

(72) Inventors: Tomohiko Yamakawa, Osaka (JP); Lin Lu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/686,997

(22) Filed: Apr. 15, 2015

(65) Prior Publication Data

US 2015/0301488 A1 Oct. 22, 2015

(30) Foreign Application Priority Data

Apr. 16, 2014 (JP) ..... 2014-084532

(51) Int. Cl.
*G03G 15/20* (2006.01)

(52) U.S. Cl.
CPC ..... *G03G 15/2085* (2013.01)

(58) Field of Classification Search
CPC ..... G03G 15/2085; G03G 15/2064
See application file for complete search history.

(56) References Cited

U.S. PATENT DOCUMENTS

2013/0302054 A1* 11/2013 Uehara ..... G03G 15/2064 399/67

FOREIGN PATENT DOCUMENTS

JP 2008-112043 A 5/2008

* cited by examiner

*Primary Examiner* — David Bolduc
*Assistant Examiner* — Barnabas Fekete
(74) *Attorney, Agent, or Firm* — Studebaker & Brackett PC

(57) ABSTRACT

A fixing device includes a first rotary member, a second rotary member, a support member having a connection part, an urging member, and an engaging member. The engaging member is capable of changing a state of the fixing device between a pressure applied state and a pressure reduced state using the urging member and the support member. When the nip pressure is in the pressure applied state, the engaging member changes a position of the urging member to direct the urging member longitudinally in a tangential direction to an arc that has a center coinciding with a center of rotation of the support member and that passes through the connecting portion. When the nip pressure is in the pressure reduced state, the engaging member changes the position of the urging member to direct the urging member longitudinally in a direction different from the tangential direction.

9 Claims, 5 Drawing Sheets

FIXING DEVICE AND IMAGE FORMING APPARATUS

INCORPORATION BY REFERENCE

The present application claims priority under 35 U.S.C. §119 to Japanese Patent Application No. 2014-084532, filed Apr. 16, 2014. The contents of this application are incorporated herein by reference in their entirety.

BACKGROUND

The present disclosure relates to fixing devices and image forming apparatuses.

Electrographic image forming apparatuses include a fixing device that fixes a toner image to a sheet by applying heat and pressure. The fixing device of such an image forming apparatus is provided with a cam to change the pressure according to the thickness of a sheet to which a toner image is to be fixed. To print on a sheet of which part is thick, such as an envelope, the pressure is reduced when compared with that applied to plain paper, thereby reducing production of wrinkles in the sheet.

SUMMARY

A fixing device according to the present disclosure fixes toner to a recording medium. The fixing device includes a first rotary member, a second rotary member, a support member including a connecting portion, an urging member, and an engaging member. The second rotary member is located opposite to the first rotary member. The second rotary member forms a nip part with the first rotary member. The support member is turnable about a center of rotation thereof. The support member engages with the first rotary member or the second rotary member. The support member is capable of changing a nip pressure at the nip part by turning. The urging member is connected to the support member at the connecting portion of the support member. The engaging member can change a state of the fixing member between a pressure applied state and a pressure reduced state using the urging member and the support member. In the pressure applied state, the nip pressure is a first nip pressure. In the pressure reduced state, the nip pressure is a second pressure lower than the first nip pressure. When the nip pressure is in the pressure applied state, the engaging member changes a position of the urging member to direct the urging member longitudinally in a tangential direction to an arc that has a center coinciding with the center of rotation of the support member and that passes through the connecting portion. When the nip pressure is in the pressure reduced state, the engaging member changes the position of the urging member to direct the urging member longitudinally in a direction different from the tangential direction.

An image forming apparatus according to the present disclosure includes the fixing device as described above and an image forming section. The image forming section transfers a toner image to a recording medium; The fixing device fixes the toner image to the recording medium.

DETAILED DESCRIPTION

Figure 1:
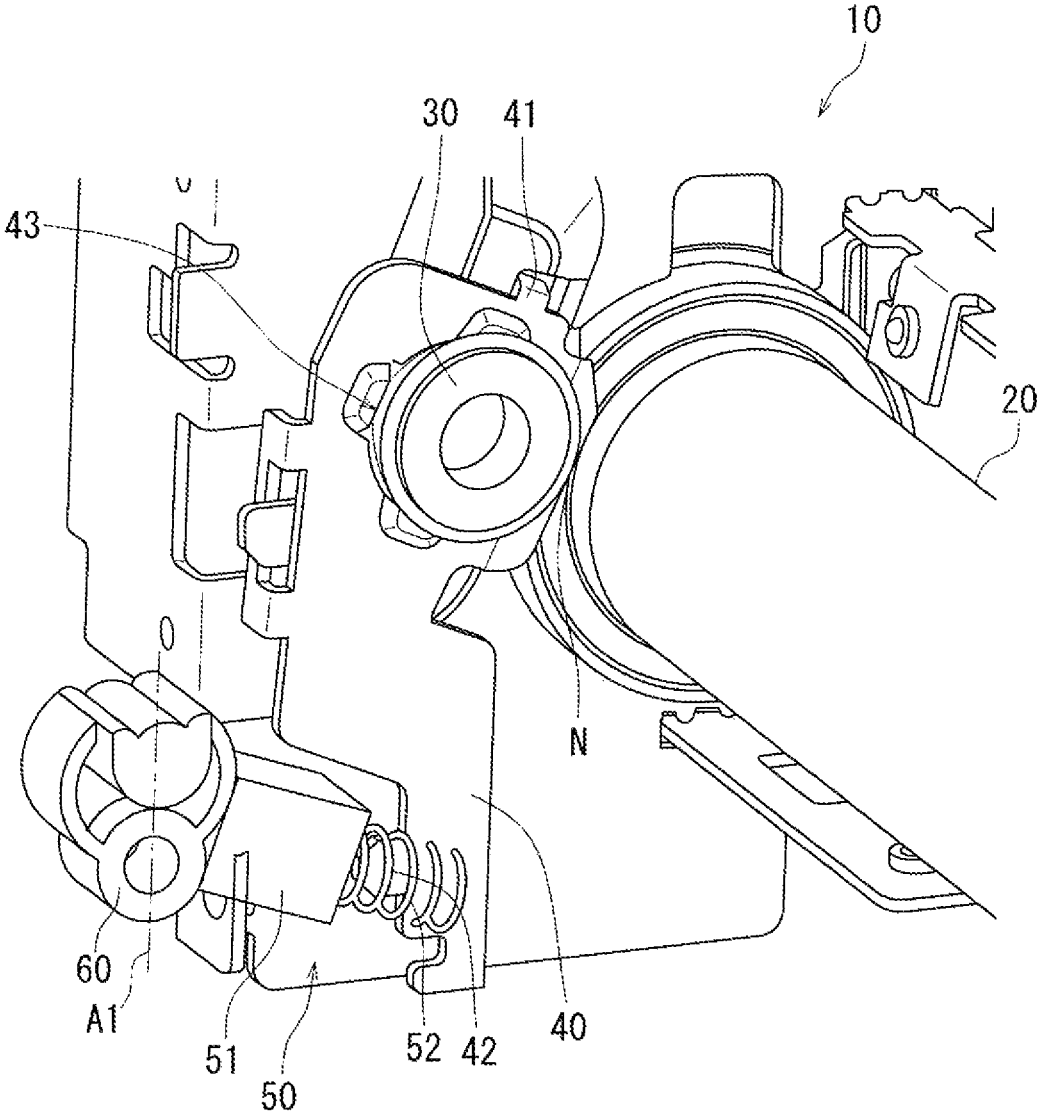
FIG. 1 is a perspective view of a fixing device according to a first embodiment of the present disclosure.

The following describes the present disclosure by way of several examples, with reference to the accompanying drawings. Like numerals denote like elements or corresponding elements in the drawings, and duplicate description shall be omitted.

[First embodiment]

With reference to FIG. 1, a fixing device 10 according to a first embodiment of the present disclosure will be described. FIG. 1 is a perspective view of the fixing device according to the first embodiment of the present disclosure.

The fixing device 10 includes a heating roller 20 (a first rotary member), a pressure roller 30 (a second rotary member), a support member 40, an urging member 50, and an engaging member 60. The fixing device 10 fixes toner to a sheet (a recording medium) by applying heat and pressure to the sheet to melt unfixed toner on the sheet.

The heating roller 20 is cylindrical and rotatable. The heating roller 20 includes a heater. The heater may be a halogen heater, a ceramic heater, or a carbon heater, for example. The heater heats the heating roller 20. The heater extend in the longitudinal direction of the heating roller 20. The heater is arranged in parallel to the axis of rotation of the heating roller 20.

The pressure roller 30 is cylindrical and rotatable. The pressure roller 30 is located opposite to the heating roller 20. The pressure roller 30 forms a nip part N with the heating roller 20.

The support member 40 is turnable about a center 41 of rotation (fulcrum) thereof. The support member 40 includes an engaging portion 43 that engages with the pressure roller 30. Turning the support member 40 can result in change in pressure (nip pressure) on the nip part N. The support member 40 includes a connecting portion 42.

The urging member 50 includes a housing 51 and a spring 52. The urging member 50 is connected to the support member 40 at the connecting portion 42 (point of effort) of the support member 40. The urging member 50 is located between the support member 40 and the engaging member 60. The spring 52 has one end connected to the housing 51 and the other end connected to the connecting portion 42. The housing 51 is in contact with the engaging member 60.

The engaging member 60 may be a cam, for example. The engaging member 60 has line symmetry with respect to an axis A1 of symmetry. The engaging member 60 is turnable. Turning the engaging member 60 changes a part of the surface of the engaging member that is in contact with the urging member 50. The engaging member 60 can change a state of the fixing device 10 between a pressure applied state and a pressure reduced state using the urging member 50 and the support member 40. In the pressure applied state, the support member 40 is close to the heating roller 20. In the pressure applied state, the nip pressure is accordingly high and will be referred to as a first nip pressure. In the pressure reduced state, the support member 40 is away from the heating roller 20 farther than that in the pressure applied state. In the pressure reduced state, the nip pressure is accordingly lower than the first nip pressure and will be referred to as a second nip pressure. The state of the fixing device 10 is changed between the pressure applied state and the pressure reduced state by changing the position of the urging member 50 according to the thickness of a sheet to which a toner is to be fixed. For example, to fix toner to a sheet of plain paper, the position of the urging member 50 is changed so that the fixing device 10 is in the pressure applied state, that is, such that the support member 40 turns toward the heating roller 20. By contrast, to fix toner to an envelope, the position of the urging member 50 is changed so that the fixing device 10 is in the pressure reduced state, that is, such that the support member 40 turns away from the heating roller 20.

The pressure roller 30 of the fixing device 10 is driven to rotate by a power source. Rotation of the pressure roller 30 generates a friction force on the pressure roller 30 to drive to rotate the heating roller 20. A sheet conveyed to the fixing device 10 passes through the nip part N. As a result, unfixed toner on the sheet is pressed and attached to the sheet. To supply sufficient heat to the sheet and the unfixed toner, the pressure roller 30 presses the heating roller 20 to form the nip part N with the heating roller 20.

Figure 2:
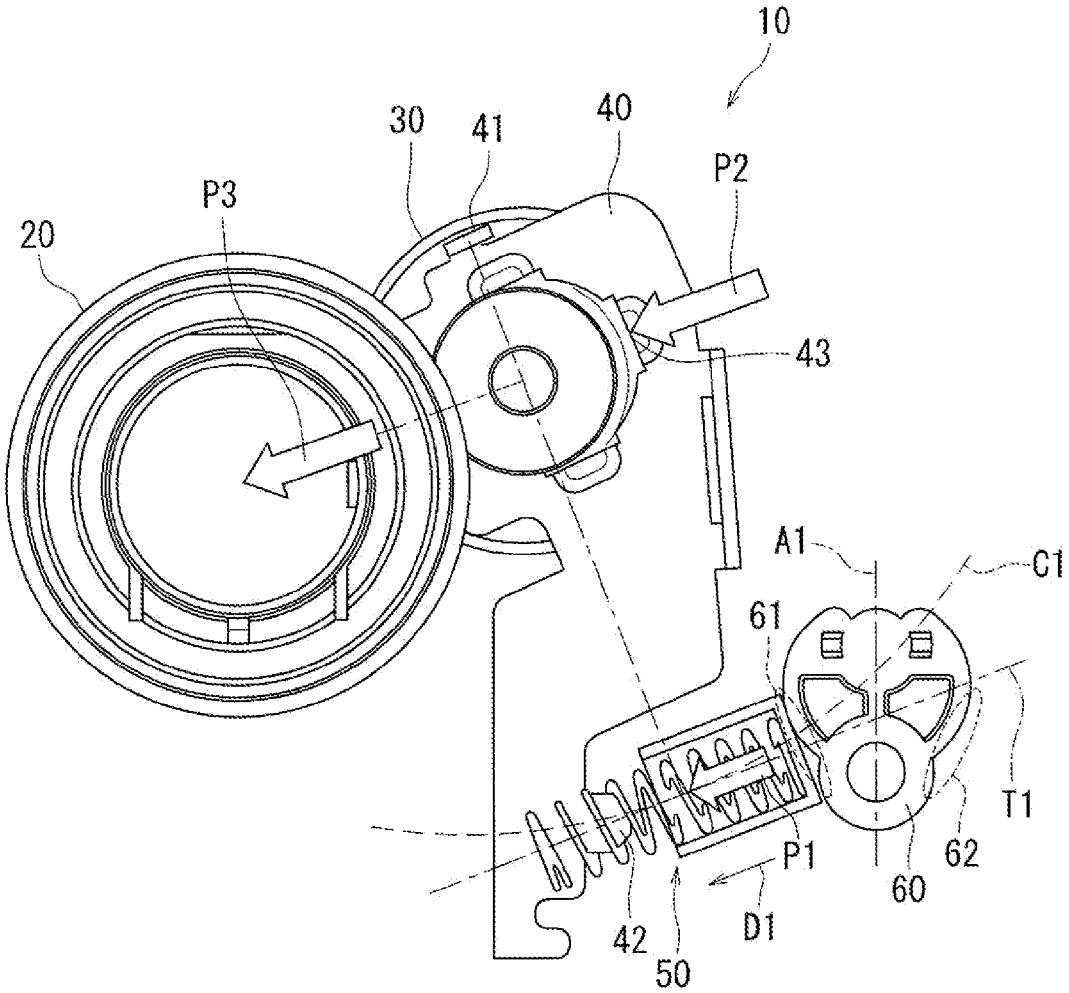
FIG. 2 is a side view of the fixing device according to the first embodiment of the present disclosure.

The following describes the fixing device 10 in the pressure applied state according to the first embodiment of the present disclosure with reference to FIG. 2. FIG. 2 is a side view of the fixing device 10 according to the first embodiment of the present disclosure. An arc C1 in FIG. 2 indicates a part of a circle that has a center coinciding with the center 41 of rotation of the support member 40 and that passes through the connecting portion 42. A tangent T1 indicates a tangent of the arc C1. The support member 40 turns about the center 41 of rotation thereof as a fulcrum with the connecting portion 42 as a point of effort and the engaging portion 43 of the support member 40 as a point of action.

When changing the pressure applied state, the engaging member 60 changes the position of the urging member 50 such as to direct the urging member 50 longitudinally in the tangential direction D1 to the arc C1. Specifically, the engaging member 60 is changed in direction such as to direct a first recessed portion 61 of the engaging member 60 to lower left in FIG. 2. As a result, the first recessed portion 61 comes in contact with the urging member 50 to direct the urging member 50 longitudinally in the tangential direction D1. A force P1 of the urging member 50 in the tangential direction D1 is accordingly applied to the point of effort, that is, the connecting portion 42. Application of the force P1 to the point of effort results in application of a force P2 to the point of action, that is, the engaging portion 43 of the support member 40. All components of the force P2 applied to the engaging portion 43 are transmitted to the heating roller 20 as a force P3 via the pressure roller 30. Thus, force can be applied to the heating roller 20 efficiently.

Figure 3:
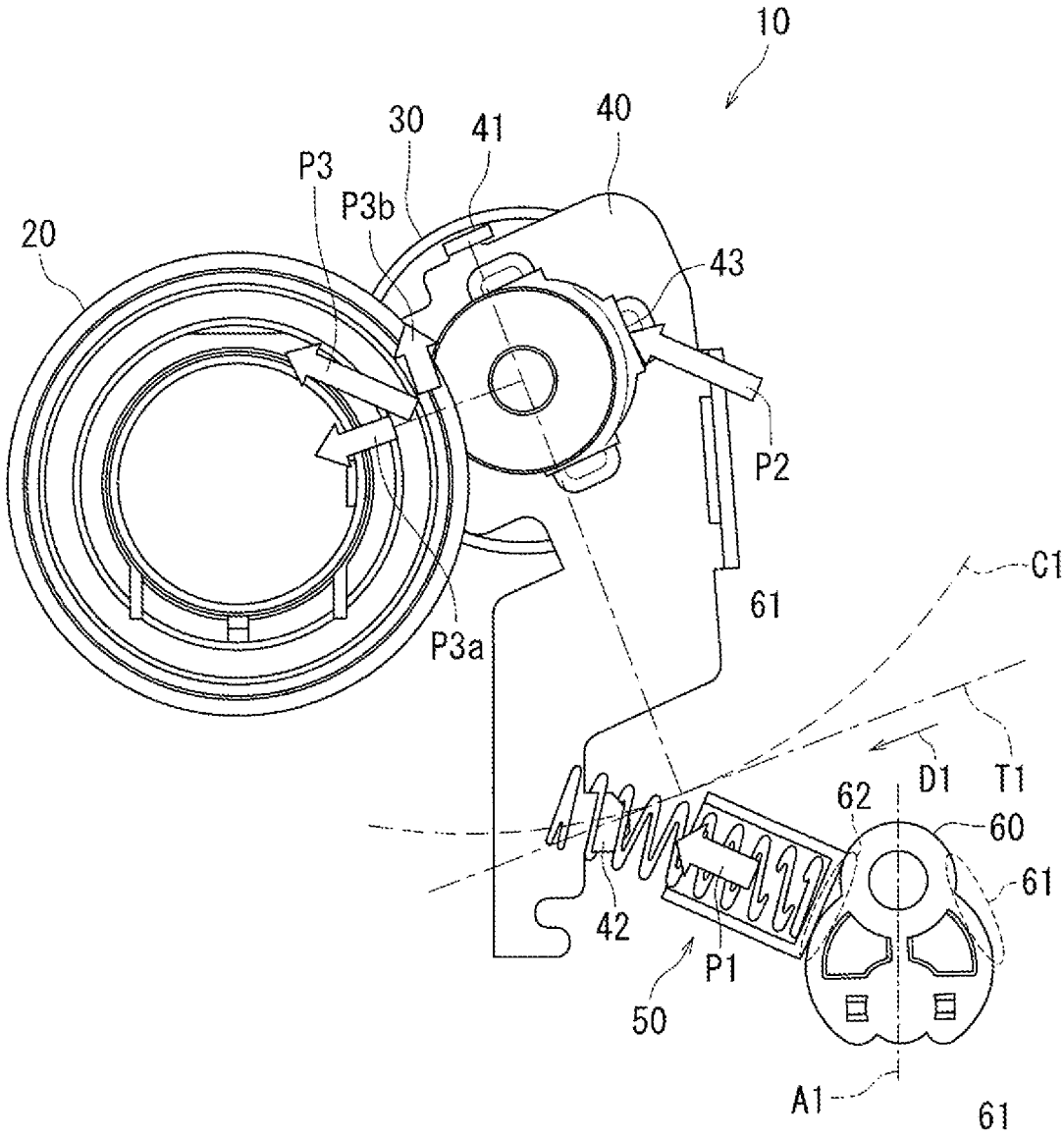
FIG. 3 is a side view of the fixing device according to the first embodiment of the present disclosure.

The following describes the fixing device 10 in the pressure reduced state according to the first embodiment of the present disclosure with reference to FIG. 3. FIG. 3 is a side view of the fixing device 10 according to the first embodiment of the present disclosure.

When changing the pressure reduced state, the engaging member 60 changes the position of the urging member 50 such as to direct the urging member 50 longitudinally in a direction different from the tangential direction D1 to the arc C1. Specifically, the engaging member 60 is changed in direction such as to direct a second recessed portion 62 of the engaging member 60 to upper left in FIG. 3. As a result, the second recessed portion 62 comes in contact with the urging member 50 to direct the urging member 50 longitudinally in the direction different from the tangential direction D1. In the present embodiment, the urging member 50 urges the support member 40 in the direction toward the interior of the arc C1 (to upper left in FIG. 3 herein) in the pressure reduced state. The force P1 of the urging member 50 in the direction different from the tangential direction D1 is accordingly applied to the point of effort, that is, the connecting portion 42. Application of the force P1 to the point of effort results in application of the force P2 to the point of action, that is, the engaging portion 43 of the support member 40. The force P2 applied to the engaging portion 43 is transmitted to the heating roller 20 via the pressure roller 30 as dispersed force components P3*a* and P3*b* of the force P3 that is to be act on the heating roller 20. Thus, appropriately reduced force can be applied to the heating roller 20 when compared with that during the pressure applied state.

The engaging member 60 has line symmetry with respect to the axis A1 of symmetry. As such, the urging member 50 is directed longitudinally in the different directions between in the pressure applied state and in the pressure reduced state by changing the direction of the engaging member 60 upside down in the pressure applied state relative to that in the pressure reduced state. Through the above, force can be applied to the heating roller 20 efficiently during the pressure applied state and appropriately reduced force when compared with that during the pressure applied state can be applied to the heating roller 20 during the pressure reduced state.

Figure 4:
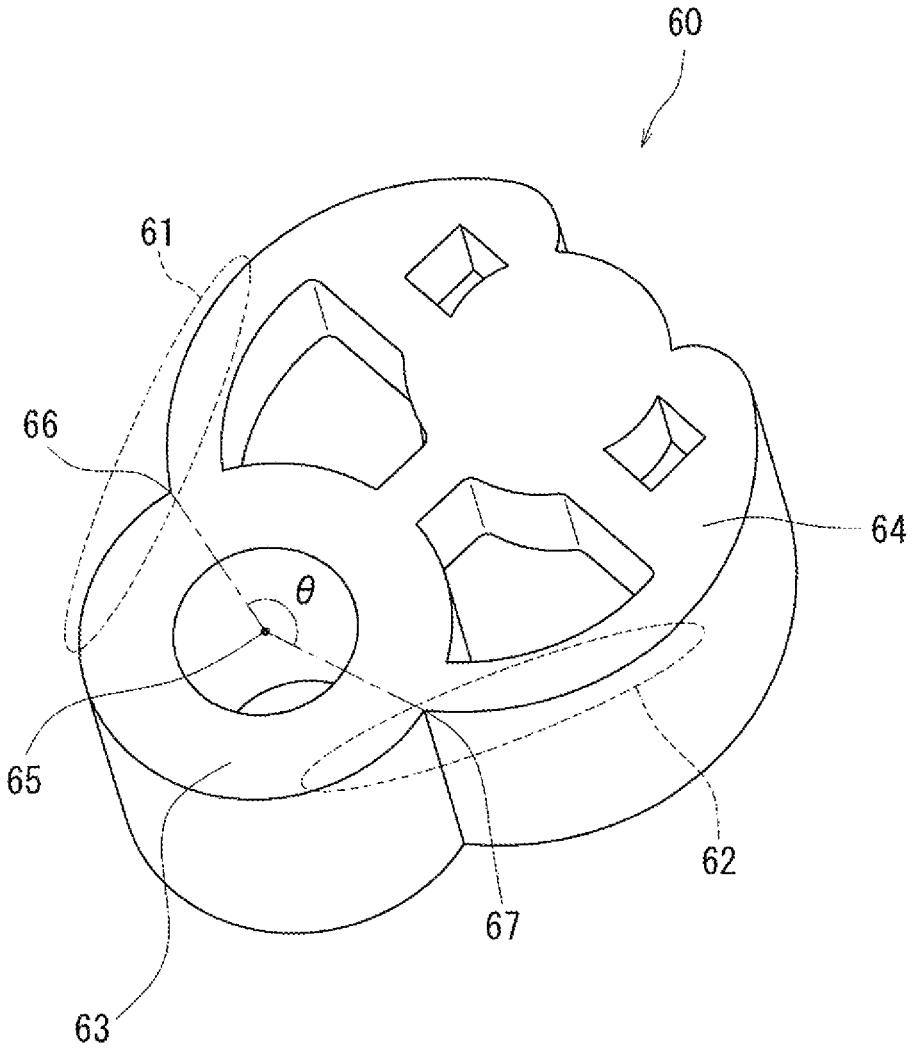
FIG. 4 is a perspective view of an engaging member of the fixing device according to the first embodiment of the present disclosure.

With reference to FIG. 4, the engaging member 60 of the fixing device 10 according to the first embodiment of the present disclosure will be described. FIG. 4 is a perspective view of the engaging member 60 of the fixing device 10 according to the first embodiment of the present disclosure.

The engaging member 60 includes the first recessed portion 61 and the second recessed portion 62. The engaging member 60 includes a circular portion 63 and an elliptical portion 64 that are combined together to have a tumbler shape. The circular portion 63 has a diameter smaller than the major axis of the elliptical portion 64. The circular portion 63 has a center 65 located on an extension of the minor axis of the elliptical portion 64 thereof. The contour of the circular portion 63 meets the contour of elliptical portion 64 at a first intersection 66 and a second intersection 67. An angle θ defined between the first and second intersections 66 and 67 with respect to the center 65 of the circular portion 63 is smaller than 180 degrees. As such, the engaging member 60 is constricted at the first and second recessed portions 61 and 62. In the pressure applied state, the first recessed portion 61 is in contact with the urging member 50. By contrast, in the pressure reduced state, the second recessed portion 62 is in contact with the urging member 50. With the first and second recessed portions 61 and 62, which are constricted in the engaging member 60, the urging member 50 cannot be displaced during both the pressure applied state and the pressure reduced state. Thus, force that the heating roller 20 receives can be kept constant during both the pressure applied state and the pressure reduced state.

As has been described with reference to FIGS. 1-4, by the engaging member 60 of the fixing device 10, the position of the urging member 50 is changed to direct the urging member 50 longitudinally in the tangential direction D1 to the arc C1 in the pressure applied state and changed to direct it longitudinally in the direction different from the tangential direction to the arc C1 in the pressure reduced state. Thus, force can be applied to the heating roller 20 efficiently during the pressure applied state and appropriately reduced force when compared with that during the pressure applied state can be applied to the heating roller 20 during the pressure reduced state. As a result, force can be applied to the heating roller 20 efficiently according to the thickness of the sheet.

[Second Embodiment]

Figure 5:
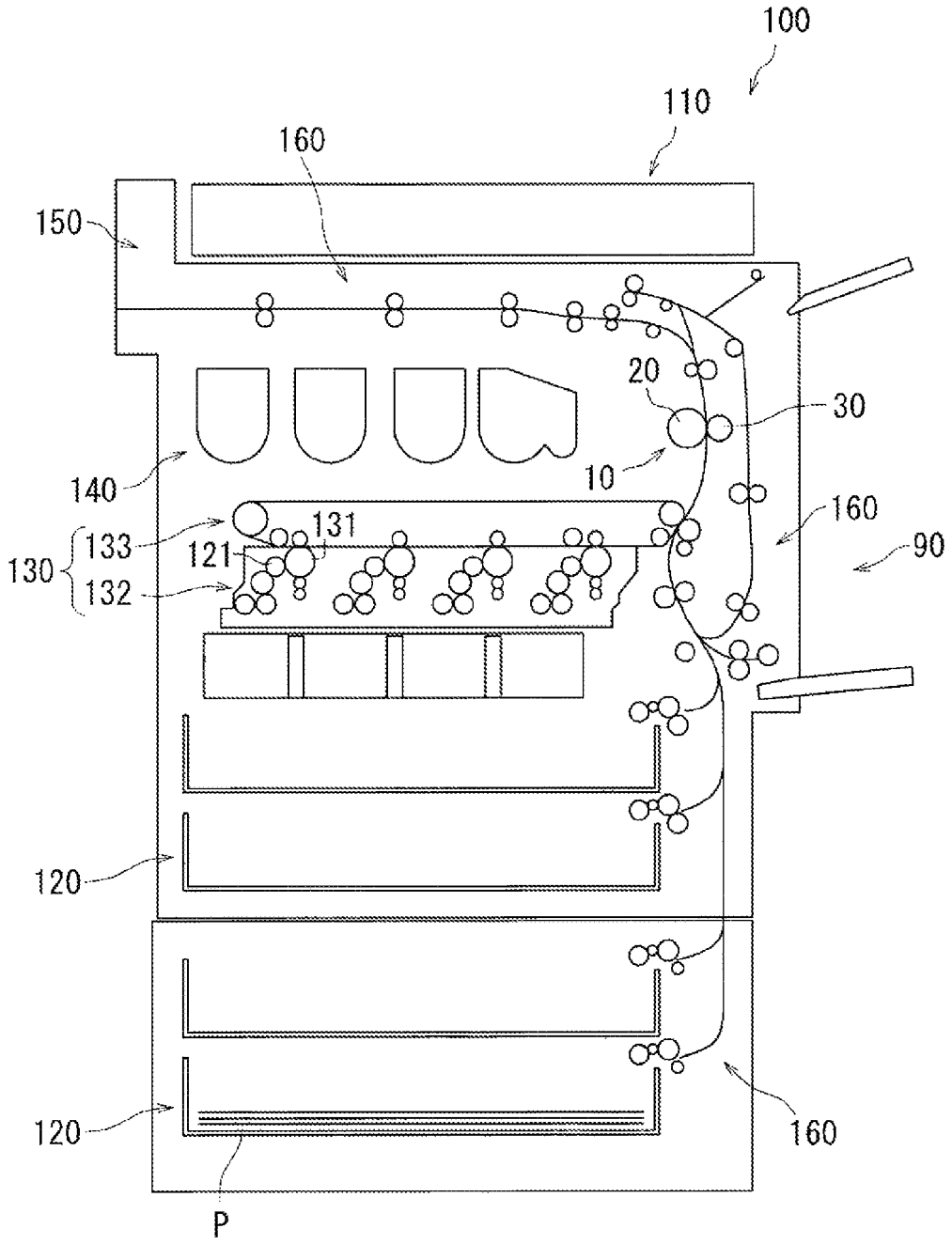
FIG. 5 is a schematic illustration of an image forming apparatus according to the second embodiment of the present disclosure.

FIG. 5 is a schematic illustration of an image forming apparatus 100 according to a second embodiment of the present disclosure. The image forming apparatus 100 may be a copier, a printer, a facsimile machine, or a multifunction peripheral having the functions of them. The following description is made about a copier as an example of the image forming apparatus 100 in the present disclosure. However, the present disclosure is not limited to the copier. The image forming apparatus 100 includes the fixing device 10, an image reading section 110, and an image forming section 90. The image forming section 90 includes a sheet feed cassette 120, an imaging section 130, a toner replenishment device 140, a sheet ejecting section 150, and a sheet conveyance section 160. The image forming section 90 forms an image based on image data read by the image reading section 110.

The sheet feed cassette 120 accommodates sheets P for printing. In copying, the sheets P in the sheet feed cassette 120 are conveyed, one at a time, through the imaging section 130 and the fixing device 10 by the sheet conveyance section 160 and ejected from the sheet ejecting section 150.

The imaging section 130 forms an image on a sheet P. The imaging section 130 includes a photoreceptor 131, a developing device 132, and a transfer device 133.

An electrostatic latent is formed on the photoreceptor 131 using a laser based on electronic signals representing an original document image generated by the image reading section 110. The developing device 132 includes a development roller 121. The development roller 121 develops the electrostatic latent image by supplying toner to the photoreceptor 131 to form a toner image on the photoreceptor 131. The toner is replenished to the developing device 132 from the toner replenishment device 140.

The transfer device 133 transfers the toner image formed on the photoreceptor 131 to the sheet P.

Application of heat and pressure to the sheet P by the fixing device 10 melts unfixed toner of the toner image formed by the imaging section 130 to fix the toner image to the sheet P. For example, once a user select a plain paper printing mode through an operation section, the position of the urging member 50 is changed to change the nip pressure between the heating roller 20 and the pressure roller 30 to the first nip pressure for fixing. By contrast, once the user select an envelope printing mode through the operation section, the position of the urging member 50 is changed to change the nip pressure between the heating roller 20 and the pressure roller 30 to the second nip pressure, which is appropriately reduced when compared with the first nip pressure, for fixing.

The embodiments of the present disclosure have been described so far with reference to FIGS. 1-5. Note that the present disclosure is not limited to the above embodiments, and a wide range of alterations can be made to the embodiments so long as such alterations do not deviate from the intended scope of the present disclosure (e.g., (1) to (4) below). The drawings are schematic illustrations that emphasize elements of configuration in order to facilitate understanding thereof. Therefore, properties of each of the elements, such as thickness, length, and number thereof, may differ from actual properties of the element. The properties of each of the elements, such as material, shape, and dimension thereof described above are mere examples and not limited specifically. A wide range of variations of the properties can be made to the embodiments so long as such variations do not deviate from the intended scope of the present disclosure.

(1) The support member 40 of the fixing device 10 according to the first embodiment engages with the pressure roller 30, but is not limited to such engagement. For example, the support member 40 may engage with the heating roller 20. In the configuration as above, the support member 40 turns toward the heating roller 20.

(2) The urging member 50 of the fixing device 10 in the first embodiment urges the support member 40 in the direction toward the interior of the arc C1 in the pressure reduced state. However, the present disclosure is not limited to such a configuration. For example, the urging member 50 may urge the support member 40 in a direction toward the exterior of the arc C1 in the pressure reduced state.

(3) The heater in the fixing device 10 in the first embodiment is provided within the heating roller 20. However, the heater may be provided on the exterior of the heating roller 20. For example, a heating induction (IH) type heater including an electromagnetic induction coil may be provided on the exterior of the heating roller 20 for heating the heating roller 20.

(4) The fixing device 10 according to the first embodiment performs fixing using a heating roller but may perform fixing using a belt. Note that a fixing device using a belt includes a pressure roller, a fixing roller, and a heating roller. The pressure roller corresponds to the first rotary member, and the fixing roller corresponds to the second rotary member.

What is claimed is:

1. A fixing device for fixing toner to a recording medium, comprising:

a first rotary member;

a second rotary member located opposite to the first rotary member and configured to form a nip part with the first rotary member;

a support member that engages with the first rotary member or the second rotary member and that is turnable about a center of rotation thereof so as to change a nip pressure at the nip part, the support member including a connecting portion;

an urging member connected to the support member at the connecting portion of the support member; and an engaging member capable of changing a state of the fixing device between a pressure applied state and a pressure reduced state using the urging member and the support member, the pressure applied state being a state in which the nip pressure is a first nip pressure, the pressure reduced state being a state in which the nip pressure is a second nip pressure lower than the first nip pressure, wherein when the nip pressure is in the pressure applied state, the engaging member changes a position of the urging member to direct the urging member longitudinally in a tangential direction to an arc that has a center coinciding with the center of rotation of the support member and that passes through the connecting portion, when the nip pressure is in the pressure reduced state, the engaging member changes the position of the urging member to direct the urging member longitudinally in a direction different from the tangential direction, and the engaging member has line symmetry.

2. The fixing device according to claim 1, wherein the engaging member has a first recessed portion and a second recessed portion, and the urging member is in contact with the first recessed portion in the pressure applied state and in contact with the second recessed portion in the pressure reduced state.

3. The fixing device according to claim 1, wherein the engaging member includes a circular portion and an elliptical portion that are combined together to have a combined shape.

4. The fixing device according to claim 3, wherein the circular portion has a diameter smaller than a major axis of the elliptical portion.

5. The fixing device according to claim 3, wherein the circular portion has a center located on an extension of a minor axis of the elliptical portion.

6. The fixing device according to claim 3, wherein a contour of the circular portion meets a contour of the elliptical portion at a first intersection and a second intersection, and an angle defined between the first intersection and the second intersection with respect to the center of the circular portion is smaller than 180 degrees.

7. The fixing device according to claim 1, wherein in the pressure applied state, the engaging member is directed upside down relative to that in the pressure reduced state.

8. The fixing device according to claim 1, wherein the urging member is located between the support member and the engaging member.

9. An image forming apparatus, comprising:

the fixing device according to claim 1; and an image forming section configured to transfer a toner image to a recording medium, wherein the fixing device fixes the toner image to the recording medium.

* * * * *